US005562424A

United States Patent [19]

Manring

[11] Patent Number: 5,562,424

[45] Date of Patent: Oct. 8, 1996

[54] PUMP DISPLACEMENT CONTROL FOR A VARIABLE DISPLACEMENT PUMP

[75] Inventor: Noah D. Manring, Roland, Iowa

[73] Assignee: Caterpillar Inc., Peoria, Ill.

[21] Appl. No.: 527,134

[22] Filed: Sep. 12, 1995

[51] Int. Cl.[6] ..... F04B 49/08

[52] U.S. Cl. ..... 417/222.1

[58] Field of Search ..... 417/218, 222.1, 417/222.2, 213; 60/445, 452

[56] References Cited

U.S. PATENT DOCUMENTS

| | | | |
|---|---|---|---|
| 4,245,962 | 1/1981 | Uehara et al. | 417/218 |
| 4,498,847 | 2/1985 | Akiyama | 417/222.1 |
| 4,599,050 | 7/1986 | Ishizaki et al. | 416/216 |
| 4,600,364 | 7/1986 | Nakatani et al. | 417/218 |
| 4,637,781 | 1/1987 | Akiyama et al. | 417/218 |

*Primary Examiner*—Timothy S. Thorpe
*Assistant Examiner*—Peter G. Korytnyk
*Attorney, Agent, or Firm*—John W. Grant

[57] ABSTRACT

A pump displacement control for a variable displacement pump includes a torque control valve serially disposed between a remotely controllable displacement control valve and a variable torque limiter in axial alignment within a common bore. A displacement control sleeve is disposed within the bore for normally controlling the fluid pressure in an actuating chamber of an actuator connected to a swashplate of the pump when the pump discharge pressure is below a predetermined high pressure. The torque control valve assumes control of pump displacement when the pump discharge pressure exceeds the predetermined high pressure and includes a sleeve and a valve spool movable relative to each other to establish a first condition communicating discharge pressure into the actuator chamber to move the swashplate toward a minimum displacement position or a second condition communicating the actuating chamber with an exhaust passage so that the swashplate is moved toward its maximum displacement position. A feedback piston continuously subjected to pump discharge pressure moves the valve spool in a direction to establish the first condition when discharge pressure exceeds the predetermined high pressure. The feedback piston is disposed in axial alignment with the valve spool within an insert disposed within the displacement control sleeve. The predetermined high pressure is varied by increasing or decreasing the level of a control pressure directed into a bore receiving a piston acting on the opposite end of the valve spool.

13 Claims, 2 Drawing Sheets

10
11
12
15
16
17a
18
21
22
24
26
28
31
32
33
36
37
43
44
46
47
53
61
66
69
72
76
79
86
87

PUMP DISPLACEMENT CONTROL FOR A VARIABLE DISPLACEMENT PUMP

TECHNICAL FIELD

This invention relates generally to a variable displacement pump and, more particularly, to a pump control having a high pressure feedback in series with a remotely controllable displacement control.

BACKGROUND ART

Variable displacement pumps require various types of displacement controls dependent upon the usage of the pump. High pressure feedback is almost always a requirement for any variable displacement control. For hydromechanical controls, this feedback is used to actuate a spring loaded spool in either a horsepower or torque limiting control, a high pressure cutoff control, or a load sensing control. Quite often, these controls utilize multiple forms of feedback to perform multiple control functions. When this is the case, the pump controls become very complicated in their design and are often characterized by large hardware configurations. Such large pump controls generally add to the overall cost of the pump.

Some variable displacement pump controls often combine a remotely controllable displacement control with an auxiliary control that utilizes high pressure feedback. Because the remotely controllable displacement control does not utilize high pressure feedback, these combined controls usually require a second bore to perform the auxiliary function. The two bore designs are larger than single bore designs and create additional cost in machining.

Finally, the maximum and minimum displacement settings of the swashplate are often established by contact between the swashplate and mechanical stops. This creates a hard stop which generates excessive noise.

In view of the above, it would be desirable to combine the remotely controllable displacement control with the high pressure feedback in a common bore. In effect, by eliminating the second bore, the overall size and cost of the control would be reduced. It would also be desirable to provide the combination of controls without the use of any double diameters to minimize the potential for concentricity interference. Finally, when the high pressure feedback is used in a torque limiting control, it would be advantageous to provide a maximum hydraulic stop for the pump to reduce the operating noise at maximum flow conditions. It would also be desirable to isolate the high pressure feedback from the displacement control since the displacement control doesn't need high pressure feedback.

The present invention is directed to overcoming one or more of the problems as set forth above.

DISCLOSURE OF THE INVENTION

In one aspect of the present invention, a pump displacement control is provided for a variable displacement pump having a swashplate and a servo actuator for moving the swashplate between maximum and minimum displacement positions. The servo actuator includes a servo piston operatively connected to the swashplate, a means for biasing the swashplate toward its maximum displacement position, and an actuator chamber at one end of the piston for controllably receiving a control pressure to move the swashplate toward its minimum displacement position. The pump displacement control comprises a body having a bore therein, a discharge passage communicating pressurized discharge pressure to the bore, a control passage communicating the bore with the actuator chamber, a connecting passage communicating with the bore, and an exhaust passage communicating with the bore. A controllable displacement control valve is disposed in the bore and includes a cylindrical member disposed within the body bore and having a bore opening into the body bore. A displacement control sleeve is slidably disposed within the bore in the cylindrical member and has a neutral position blocking the discharge, connecting and exhaust passages from each other. The sleeve is movable in a first direction to communicate the discharge and connecting passages and in a second direction to communicate the connecting and exhaust passages. A means is provided for exerting a variable control force against the displacement control sleeve. A torque control valve is disposed within the body bore adjacent the displacement control valve and has a torque control sleeve slidably disposed within the body bore and mechanically coupled to the swashplate. A valve spool is slidably disposed within the torque control sleeve wherein the valve spool and torque control sleeve are movable relative to each other to establish a first condition communicating the discharge and control passages, and a second condition communicating the control and connecting passages. A variable torque limiter is disposed within the body bore and resiliently biases the valve spool toward the displacement control valve. A compression feedback spring is disposed between the sleeves. An insert is slidably disposed within the displacement control sleeve and has a feedback bore therein in axial alignment with the valve spool and being in continuous communication with the discharge passage. A high pressure feedback piston is slidably disposed within the feedback bore wherein the feedback piston is biased into abutment with the valve spool by the discharge pressure.

Figures 1, 2:
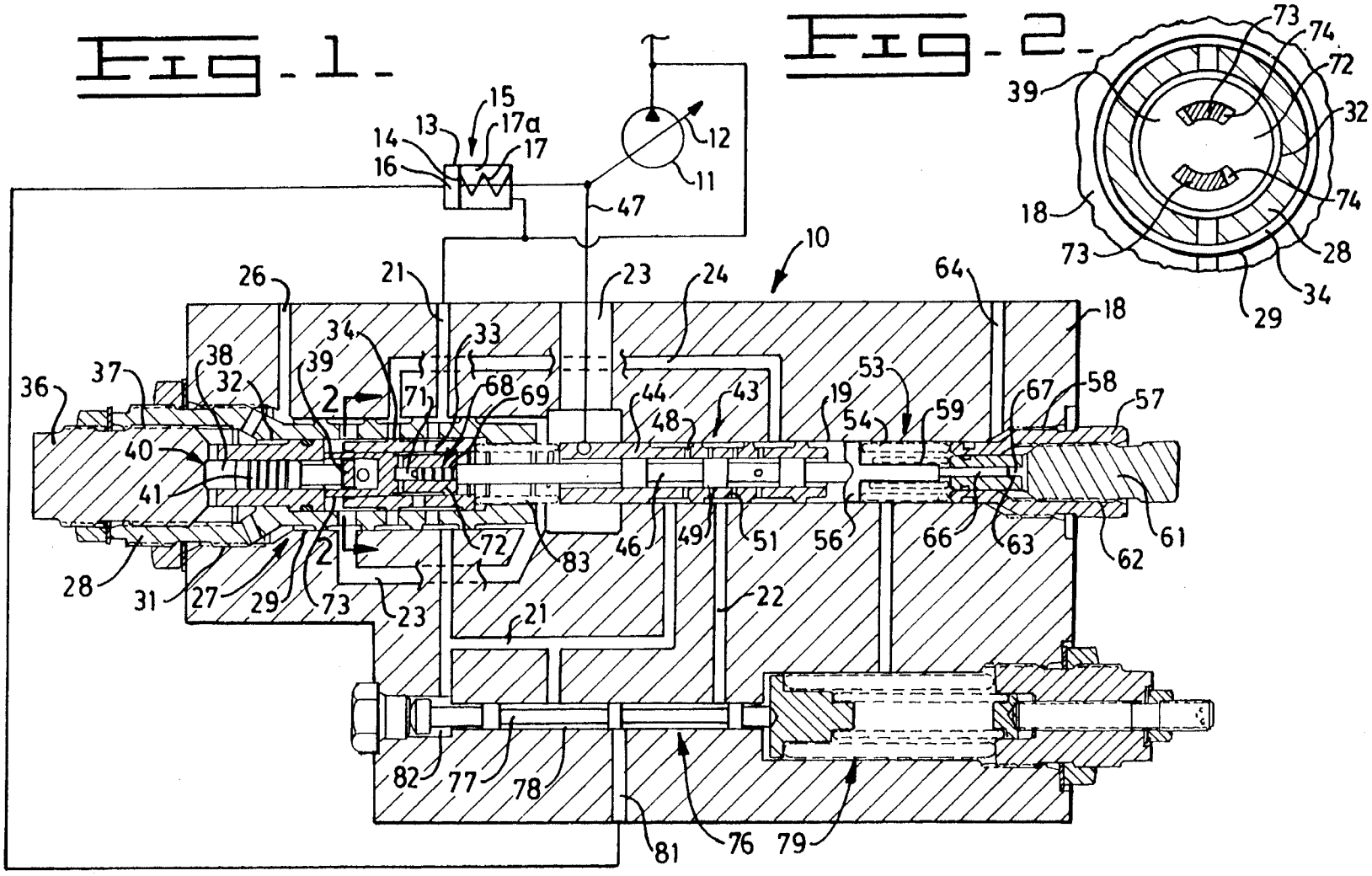
FIG. 1 is a diagrammatic sectional view illustrating an embodiment of the present invention.
FIG. 2 is a diagrammatic sectional view taken along line 2—2 of FIG. 1.

Best Mode for Carrying Out the Invention

Referring now to the drawings, a pump displacement control generally indicated by the reference numeral 10 is shown in combination with a variable displacement pump 11 having a swashplate 12 movable between maximum and minimum displacement positions. A servo actuator diagrammatically shown at 13 includes a servo piston 14 operatively connected to the swashplate 12, a means 15 for biasing the swashplate toward its maximum displacement position, and an actuator chamber 16 at one end of the piston for controllably receiving a control pressure to move the swashplate toward its minimum displacement position. The means 15 can be, for example, a compression spring 17 disposed within a chamber 17*a* connected to the pump discharge. While the pump displacement control and the servo actuator are shown separated from the variable displacement pump for illustrative convenience, these components are generally contained within or secured to the housing of the variable displacement pump.

The pump displacement control 10 includes a body 18 having a bore 19 therein, a discharge passage 21 communicating pump discharge pressure to the bore, a control passage 22 communicating the bore with the actuator chamber, an exhaust passage 23 communicating with the bore, a connecting passage 24 communicating with the bore at two axial spaced locations, and a displacement control signal port 26 communicating with the bore.

A displacement control valve 27 includes a cylindrical tubular member 28 disposed within an enlarged portion 29 of the bore 19 and is adjustably secured to the body through a threaded connection 31. The tubular member has a bore 32 extending therethrough and slidably receives a displacement control sleeve 33. The sleeve 33 has an annular land 34 thereon and is shown in its neutral position at which the land 34 blocks the connecting passage 24 from both the discharge and exhaust passages 21 and 23. The sleeve is movable leftward to communicate the discharge and connecting passages while blocking communication between the exhaust and connecting passages and is movable rightward to communicate the connecting passage with the exhaust passage while blocking communication between the connecting and discharge passages.

A maximum hydraulic stop adjustment member in the form of a piston cartridge 36 extends into and is adjustably connected to the tubular member 28 through a threaded connection 37 and has a bore 38 therein opening toward an end wall 39 of the sleeve 33. The bore 38 is in continuous communication with the signal port 26. A means 40 is provided for exerting a variable displacement control force against the sleeve 33 to bias the sleeve 33 rightward. The means 40 includes a piston 41 disposed within the bore 38 and biased into abutment with the end wall 39 by pressurized fluid directed into the bore 38 from the signal port.

A torque control valve 43 is disposed within the bore 19 for controlling fluid communication between the connecting passage and the actuator chamber 16 and between the discharge passage and the actuator chamber 16. The torque control valve includes a sleeve 44 slidably disposed within the body bore 19 and a valve spool 46 slidably disposed within the sleeve. The sleeve is operatively mechanically coupled to the piston 14 through a connecting member 47 for moving the sleeve proportional to displacement of the swashplate 12. The valve spool and the sleeve 44 are movable relative to each other to establish a first condition communicating the discharge passage 21 with the control passage 22 through annular ports 48, 49 while blocking the connecting passage 24 from the control passage 23 by blocking a pair of ports 51. The valve spool and sleeve also establish a second condition communicating the control passage 22 with the connecting passage 24 through the ports 51 while blocking communication between the discharge passage 21 and the control passage 22 by blocking fluid flow through the ports 49. A neutral condition is established by the valve spool and the sleeve blocking the discharge, control and connecting passages from each other.

A variable torque limiter 53 is disposed within the bore 19 in axial alignment with the torque control valve 43 for applying a remotely controllable variable resilient force to bias the valve spool 46 leftward to establish the second condition. The torque limiter includes a primary compression spring 54 disposed between a spring seat 56 in abutment with the valve spool 46 and a tubular spring force adjusting member 57 threadably connected to the body 18 through a threaded connection 58. A bumper spring 59 is disposed between the spring seat 56 and a stop member 61 threadably connected to the spring force adjustment member 57 through a threaded connection 62. A bore 63 in the stop member 61 slidably receives a piston 66 defining a torque control chamber 67 continuously communicating with a control port 64. The piston is biased into engagement with the spring seat 56 by torque control pressure in the chamber 67.

A means 68 is provided for applying a high pressure feedback force against the valve spool 46 proportional to the discharge pressure of the variable displacement pump so that the valve spool moves rightward relative to the sleeve 44 to establish the first condition when the control force exceeds the biasing force exerted by the torque limiter 53. The means 68 can include for example a high pressure feedback piston 69 slidably disposed within a feedback bore 71 of an insert 72 slidably positioned within the sleeve 33. The insert 72 includes a pair of axially extending fingers 73 extending through a pair of slots 74 in the end wall 39. The bore 71 continuously communicates with the discharge passage 21 so that the fingers 73 are hydraulically biased into abutment with the maximum stop member 36 and the piston 69 is continuously biased into engagement with the spool 46 by discharge pressure in the bore 71.

A high pressure cutoff 76 includes a valve spool 77 slidably disposed within a bore 78 and resiliently biased to the position shown by a spring mechanism 79. At the position shown, the valve spool 77 establishes communication between the control passage 22 and a control port 81 communicating with the actuator chamber 16. The valve spool is movable rightward to a position blocking communication between the control passage 22 and the control port 81 and communicating the discharge passage 21 with the control port 81. A chamber 82 defined at the left end of the valve spool 77 continuously communicates with the discharge passage 21.

A force feedback spring 83 is disposed between the sleeves 33 and 44.

Figure 3:
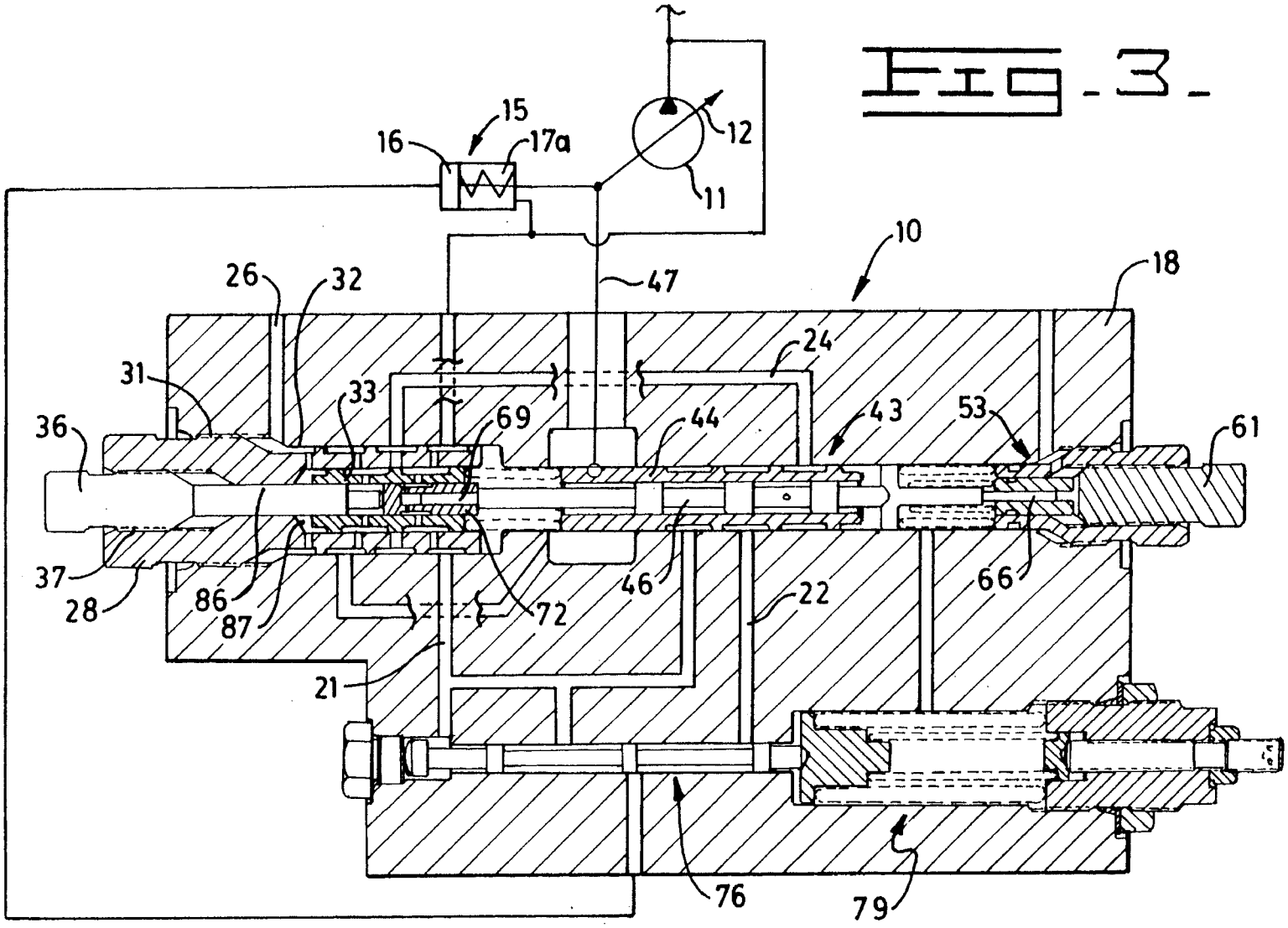
FIG. 3 is a diagrammatic sectional view illustrating another embodiment of the present invention.

An alternate embodiment of the pump displacement control 10 of the present invention is disclosed in FIG. 3. It is noted that the same reference numerals of the first embodiment are used to designate similarly constructed counterpart elements of this embodiment. In this embodiment, however, the maximum stop adjustment member 36 includes a stem 86 extending into the displacement control sleeve 33 to define a displacement control chamber 87 continuously communicating with the signal port 26. The insert 72 slidably disposed within the sleeve 33 is hydraulically biased into engagement with the stem 86 and the piston 41 is hydraulically biased into engagement with the valve spool 46 by discharge pressure in the bore 71.

Industrial Applicability

The displacement control 10 is shown at a condition in which a displacement control signal is transmitted through the signal port 26 into the bore 38 and a torque control signal is transmitted through the control port 64 into the chamber 67. The displacement control sleeve 33 is thus biased to the neutral position shown at which the connecting passage 24 is blocked from both the discharge and exhaust passages 21 and 23. The valve spool 46 is biased into engagement with the insert 72 by the torque limiter establishing the second condition at which the connecting passage 24 communicates with the control passage 22.

The pump displacement control 10 provides three stages or levels of control of the displacement of the pump 11. The first stage of control is provided by the displacement control valve 27 which normally controls the flow rate and discharge pressure until the discharge pressure reaches a predetermined high level. In this stage, the displacement setting of the pump is controlled by the pressure level of the displacement control signal in the bore 38. For example, increasing the displacement control signal initially biases the displacement control sleeve 33 rightwardly to communicate the connecting passage 24 with the exhaust passage 23. This permits fluid from the actuator chamber 16 to pass through the control port 81, the control passage 22, the radial ports 51, and the connecting passage 24 to the exhaust passage 23 so that the spring 17 and the discharge pressure in chamber 17*a* moves the piston 14 leftwardly to increase displacement of the pump. As the displacement increases, the sleeve 44 also moves leftwardly causing the feedback spring 83 to exert a force against the displacement control sleeve 33. The pump displacement will increase until the forces on the displacement control sleeve 33 reach equilibrium and the displacement control sleeve 33 again is at the neutral position to hold the piston 14 and thus the swashplate at a setting determined by the displacement control signal. Similarly, decreasing the displacement control signal causes leftward movement of the displacement control sleeve resulting in discharge pressure being transmitted to the actuator chamber 16 for changing the swashplate to a lower displacement setting.

In the above operational sequence, the fingers 73 of the insert 72 are hydraulically biased into engagement with the maximum stop adjustment member 36 by discharge pressure in the bore 71. The valve spool 46 is biased leftward into engagement with the insert by the force generated by the torque limiter 53 so long as the discharge pressure is less than a high predetermined level as determined by the level of the torque control pressure in the bore 63.

The second stage of control is provided by the torque control valve 43 which controls pump displacement when the pressure level exceeds the predetermined high level but is less than a high pressure cutoff level. When the discharge pressure exceeds the high predetermined level, the high feedback force exerted on the valve spool 46 by the feedback piston 69 in the bore 71 becomes sufficient to move the valve spool 46 rightward against the bias of the torque limiter 53 to establish the first condition of the valve spool and the sleeve 44. This blocks communication between the connecting passage 24 and the control passage 22 and communicates discharge pressure from the discharge passage 21 through the control passage 22, the control port 81 and into the actuator chamber 16, causing the swashplate to move toward minimum displacement for reducing the torque output of the pump. The predetermined pressure level at which this action takes place is controllable by varying the pressure level of the torque control signal in the usual manner. As the displacement of the pump decreases, the sleeve 44 is moved rightwardly in a follow-up manner by the connecting member 47. The rightward movement of the valve spool 46 and thus the sleeve 44 will continue until the torque level is satisfied. At that time, the sleeve 44 blocks the discharge passage 21 from the control passage 22 to maintain the swashplate at a fixed position until the torque conditions again change. The above operation normally occurs when the swashplate is at its maximum displacement setting.

The predetermined high level at which the swashplate starts to move toward the minimum displacement setting can be varied by changing the level of the torque control fluid pressure in the chamber 67 by any well-known manner. Increasing the pressure in the chamber 67 raises the predetermined high level while decreasing the pressure lowers the predetermined high level. The bumper spring 59 functions in cooperation with the spring 54 to approximate a constant torque curve.

The third stage of displacement control is provided by the high pressure cutoff 76 which controls pump displacement when the discharge pressure exceeds the high pressure cutoff level. More specifically, the spring mechanism 79 maintains the valve spool 77 in the position shown until the discharge pressure reaches a very high cutoff pressure which is typically set slightly below the maximum system pressure determined by a relief valve not shown. When the cutoff pressure is reached, the valve spool 77 is urged rightward to initially block the actuator chamber 16 from the control passage 22 and subsequently communicates discharge pressure 21 to the actuator chamber 16 for reducing the displacement of the pump to a minimum displacement setting while the discharge pressure is at a maximum level.

As the swashplate 12 approaches its maximum displacement position at anytime during operation of the pump, the sleeve 43 reaches a position establishing the neutral condition of the sleeve and valve spool 46 wherein the connecting discharge and control passages 24, 21 and 22 are blocked from each other. This stops movement of the swashplate toward maximum displacement before it contacts the mechanical stop (not shown) and thereby hydraulically establishes the maximum displacement flow setting of the swashplate. The maximum displacement setting can be adjusted by axial adjustment of the stop member 36.

Referring now to the embodiment of FIG. 3, the displacement control valve 27 functions essentially as described above in regards to the embodiment of FIG. 1 except that the displacement control signal is directed into the displacement control chamber 87 where it acts directly on the end of the displacement control sleeve 33.

In view of the above, it is readily apparent that the structure of the present invention provides an improved pump displacement control which combines the remotely controlled displacement control with the high pressure feedback in a common bore, thereby eliminating the need for a second bore and thus reducing the overall cost of the control. This is accomplished by positioning the high pressure feedback piston operatively associated with the torque control valve within the bore of the insert slidably disposed within the displacement control sleeve so that the feedback piston directly abuts the valve spool of the torque control valve. The high pressure feedback piston is thus isolated from the displacement control valve and provides for independent operation of both the displacement control valve and the torque control valve. Positioning the feedback piston so that it abuts the valve spool permits the displacement control valve and the torque control valve to be located within the same bore while eliminating concentricity interference between the various sliding elements.

Other aspects, objects and advantages of this invention can be obtained from a study of the drawings, the disclosure and the appended claims.

I claim:

1. A pump displacement control for a variable displacement pump having a swashplate movable between maximum and minimum displacement positions and a servo actuator including a servo piston operatively connected to the swashplate, means for biasing the swashplate toward its maximum displacement position, and an actuator chamber at one end of the piston for controllably receiving a control pressure to move the swashplate toward its minimum displacement position, the pump displacement control comprising:

a body having a bore therein, a discharge passage communicating discharge pressure to the bore, a control passage communicating the bore with the actuator chamber, and a connecting passage and an exhaust passage communicating with the bore;

a controllable displacement control valve disposed in the bore and including a cylindrical member disposed Within the body bore and having a bore opening into the body bore, a displacement control sleeve slidably disposed within the bore in the cylindrical member and being movable in a first direction from a neutral position to communicate the discharge and connecting passages and in a second direction to communicate the connecting and exhaust passages;

means for exerting a variable control force against the displacement control sleeve;

a torque control valve disposed within the body bore adjacent the displacement control valve and having a torque control sleeve slidably disposed within the body bore and mechanically coupled to the swashplate, and a valve spool slidably disposed within the torque control sleeve wherein the valve spool and torque control sleeve are movable relative to each other to establish a first condition communicating the discharge and control passages and a second condition communicating the control and connecting passages;

a variable torque limiter disposed within the body bore resiliently biasing the valve spool in a direction toward the displacement control valve;

a compression feedback spring disposed between the sleeves;

an insert slidably disposed within the displacement control sleeve and having a feedback bore therein in axial alignment with the valve spool and being in continuous communication with the discharge passage; and a high pressure feedback piston slidably disposed within the feedback bore wherein the feedback piston is biased into abutment with the valve spool by the discharge pressure.

2. The pump displacement control of claim 1 wherein the displacement control sleeve has an end wall and the control force exerting means includes a piston cartridge adjustably disposed within the cylindrical member and having a piston bore therein and a piston slidably disposed within the piston bore in abutment with the end wall.

3. The pump displacement control of claim 2 wherein the end wall has a plurality of openings extending therethrough, the insert including a pair of fingers extending through the openings and abutting the piston cartridge.

4. The pump displacement control of claim 1 wherein the valve spool is biased into abutment with the insert by the torque limiter and cooperates with the torque control sleeve to hydraulically stop the swashplate at its maximum displacement setting.

5. The pump displacement control of claim 4 wherein the cylindrical member is axially adjustable relative to the body.

6. The pump displacement control of claim 5 wherein the piston cartridge is axially adjustable relative to the cylindrical member to adjust the maximum displacement setting of the swashplate.

7. The pump displacement control of claim 1 wherein the torque limiter includes a spring disposed to bias the spool in said direction and a spring force adjustment member adjustably positioned in the body bore in contact with the spring.

8. The pump displacement control of claim 7 wherein the torque limiter includes a piston and a torque control chamber defined in part by the piston, the piston being disposed to controllably exert a force biasing the spool in said sleeve when control fluid is directed to the torque control chamber.

9. The pump displacement control of claim 8 wherein the spring force adjustment member is tubular and including a spring seat disposed between the spring and the valve spool and another spring force adjustment member adjustably disposed within the spring force adjustment member and having a bore therein, and a bumper spring disposed between the other spring force adjustment member and the spring seat, the piston being slidably disposed within the bore in the other spring force adjustment member and being in abutment with the spring seat.

10. The pump displacement control of claim 1 wherein the valve spool and the sleeve are movable to establish a neutral condition blocking the control passage from the connecting passage and including means for hydraulically stopping movement of the swash plate toward the maximum displacement position, the means including a maximum displacement stop positioned to stop movement of the valve spool in the first direction at a predetermined position to establish the neutral condition of valve spool and the sleeve.

11. The pump displacement control of claim 10 wherein the maximum displacement stop is adjustably disposed in axial alignment with the valve spool.

12. The pump displacement control of claim 1 including a high pressure cutoff disposed within the control passage and including another bore defined in the body and communicating with the control passage, and a valve spool slidably disposed in the other bore for controlling communication between the actuator chamber and the control passage and between the discharge passage and the actuator chamber.

13. The pump displacement control of claim 12 wherein the high pressure cutoff includes a chamber at one end of the valve spool of the high pressure cutoff and being in continuous communication with the discharge passage, and a spring mechanism disposed for resisting movement of the valve spool of the high pressure cutoff in a direction to communicate the discharge passage with the actuator chamber.

* * * * *